US008839730B2

(12) United States Patent
Shamblin

(10) Patent No.: US 8,839,730 B2
(45) Date of Patent: Sep. 23, 2014

(54) DRIFT CONTROL SYSTEM

(75) Inventor: Robert Shamblin, Tampa, FL (US)

(73) Assignee: JL Marine Systems, Inc., Tampa, FL (US)

( * ) Notice: Subject to any disclaimer, the term of this patent is extended or adjusted under 35 U.S.C. 154(b) by 119 days.

(21) Appl. No.: 13/507,926

(22) Filed: Aug. 7, 2012

(65) Prior Publication Data

US 2014/0041568 A1 Feb. 13, 2014

(51) Int. Cl.
*B63H 25/06* (2006.01)

(52) U.S. Cl.
USPC ..... 114/162

(58) Field of Classification Search
CPC ..... B63H 21/265; B63H 25/10; B63H 25/38; B63H 25/382; B63H 1/36; B63H 16/12; B63H 16/04
USPC ..... 114/153, 162, 163, 165; 440/14, 15; 441/79
See application file for complete search history.

(56) References Cited

U.S. PATENT DOCUMENTS 8,100,075 B2 * 1/2012 Wang ..... 114/153
8,210,114 B2 * 7/2012 Nysether et al. ..... 114/162

* cited by examiner

*Primary Examiner* — Lars A Olson
(74) *Attorney, Agent, or Firm* — Arthur W. Fisher, III

(57) ABSTRACT

A drift control system including at least one drift control device for use with a small boat to effect the direction and speed of drift of the small boat against the forces of wind and current comprising a rudder-like member adjustably coupled to the small boat by a mounting assembly including a first mounting bracket coupled to the small boat and a second mounting bracket rotatably coupled to the first mounting bracket by a coupling member and attached to the rudder-like member, and an adjustable locking assembly to selectively secure the rudder-like member in one of a plurality of positions relative to the small boat to effect the direction and speed of drift of the small boat against the forces of wind and current.

43 Claims, 5 Drawing Sheets

DRIFT CONTROL SYSTEM

BACKGROUND OF THE INVENTION

1. Field of the Invention

A drift control device for use with a small boat adrift to effect the direction and drift speed of the small boat against the forces of wind and current.

2. Description of the Prior Art

Often, fishermen fish from a boat while adrift.

A boat adrift relatively close to the shore-line or river bank while fishing will generally cause the small boat to veer into the direction of the wind commonly referred to as weather-cocking. Weather-cocking can force the boat toward or away from the shore-line or river bank.

The degree of weathercocking depends on such various factors as wind angle, the shape and profile of the small boat's hull, the small boat's load distribution, the amount of hull side-slip which is governed by wind force and hull draft, and the depth of the water in which it is being operated.

Various devices have been invented to provide directional control accounting for the current and wind forces on a water craft. Pertinent examples of the prior art are disclosed below.

U.S. Pat. No. 4,889,006 shows a kayak steering apparatus for controlling kayak weathercocking during operation in side wind conditions. An elastomeric line in tension and a non-elastic control line are each attached to opposite side arms of a vertically pivoting rotor which is mounted to the stern of a kayak with the rotor further being connected to a rudder. A kayak operator can, by hand, pull on or release the control line which acts in combination with tension in the elastomeric line to turn the rotor and thereby set rudder angular position. For setting vertical depth, the rudder is connected to the rotor by a pin which allows the rudder to pivot about a generally horizontal axis. Depth adjustment is also hand controllable by pulling or releasing a line connected to the upper portion of the rudder at a location offset from the horizontal axis defined by the pivoting pin.

U.S. Pat. No. 3,990,385 teaches a self-steering mechanism for a sailboat comprising the combination of a wind vane mounted for rotation about a substantially vertical axis coupled to a differential hydraulic pressure regulator. A hydraulic motor and pump is provided having a pressure regulator located between the motor and pump. The arrangement is such that the hydraulic pump, which can be driven by movement of the vessel through the water, the wind or other suitable sources, provides the hydraulic pressure required to operate the hydraulic motor, which motor is controlled by a differential hydraulic pressure regulator that is mechanically coupled to the wind vane. In this fashion the sailboat rudder which is coupled to the hydraulic motor can be controlled relative to the angle of attack of the wind against the wind vane.

U.S. Pat. No. 4,203,380 discloses a rudder assembly for a boat including a rudder shaft rotatably mounted to a boat and inclined downwardly and rearwardly. A rudder blade is attached to the lower end of the shaft and a plate is attached to the lower edge of the blade. The inclined shaft permits control of the rudder assembly from the central portion of the boat while allowing the rudder blade to be disposed near the stern for improved control. The plate provides for increasing resistance to the flow of water as the rudder blade is moved to the left or right of the straight-on position.

U.S. Pat. No. 4,327,657 describes a self-steering system to maintain a sailing craft on a preselected heading relative to the apparent wind. An oar member which forms a hydrodynamic servo is mounted on a center body for rotational motion. Also supported on the center body above the oar member is a wind vane which is mounted for rotational adjustment and for pivotal motion substantially normal to its rotational axis. The center body is pivotally supported on the transom of the sailing craft for motion about an axis approximately parallel to the longitudinal center line of the boat. The wind vane is coupled to the oar member such that when the heading of the sailing craft changes relative to the apparent wind, the wind vane is pivotally driven sidewise by the wind and through its linkage thereto rotatably drives the oar member. Such rotatable motion of the oar member from a predetermined neutral position results in sidewise water forces thereon which pendulously drive the oar member sidewise and along with it rotate the center body and the vane base. The center body is coupled through a suitable linkage to the steering control of the sailing craft such that the sidewise pendulous motion of the oar causes the steering control to drive the rudder of the sailing craft in a direction such as to maintain the sailing craft on the preselected heading relative to apparent wind.

U.S. Pat. No. 4,348,973 relates to a self steering apparatus for a boat comprising a motion transfer apparatus for converting pivotal movement of a wind vane into rotational movement of a rudder. The latter is located in a support which is pivotable about the fore and aft axis of the boat. A rotatable connection is provided between a control arm arranged for movement with the vane and a rudder arm arranged for movement with the rudder, such that, when movement of the vane is initiated, there is resultant movement of the rudder arm about the fore and aft axis with movement of the rudder about its axis, and subsequent movement by the water of the rudder support about the fore and aft axis, and movement of the control arm is effected on initial movement of the rudder about its axis but does not result from movement of the rudder support about the fore and aft axis. Lines transmit movement of the rudder support about the fore and aft axis to the main rudder or tiller of the boat.

Additional examples of the prior art are found in U.S. Pat. No. 4,372,241; U.S. Pat. No. 4,711,192; U.S. Pat. No. 7,430,976; U.S. Pat. No. 7,775,173 and U.S. Pat. No. 8,151,724.

SUMMARY OF THE INVENTION

The present invention relates to a drift control system including at least one drift control device coupled to the stern of a small boat to control the bow angle relative to the shoreline when drifting under the force of the wind and current.

The drift control device comprises a rudder-like member coupled to the stern of the small boat by a mounting assembly comprising a first mounting bracket and a second mounting bracket rotatably coupled to the first mounting bracket by a coupling member.

The first mounting bracket comprises a first base plate having a first upper coupling plate and a first lower coupling plate disposed in substantially parallel spaced relationship relative to each other to receive a portion of the second mounting bracket therebetween.

The second mounting bracket comprises a second base plate having a second upper coupling plate and a second lower coupling plate in substantially parallel spaced relationship relative to each other disposed between the first upper coupling plate and first lower coupling plate.

The drift control device further includes locking assembly to selectively lock the first mounting bracket relative to the second mounting bracket in one of a plurality of positions to adjust the angular disposition of the rudder-like or substantially pie-shaped member.

The adjustable locking assembly comprises a locking member movable between a first or locked position and a second or locked position positionable into one of a plurality of recesses or holes formed in the upper surface of the second lower coupling plate to lock or secure the first mounting bracket relative to the second mounting bracket in rotational position relative to each other and the bow of the small boat.

The locking member is normally held in the first or locked position by a positioning member.

To adjust the angle of the rudder-like member relative to the bow or center-line of the small boat to control the drift angle, the locking member is lifted upward against the force or bias of the positioning member removing the locking member from the plurality of recesses or holes such that when the second mounting bracket and rudder-like member are rotatably positioned relative to the first mounting bracket, the locking member is aligned with the selected recess or hole. The locking member is then released allowing the locking member to return to the first or locket position with the locking member seated in the proper recess or hole.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
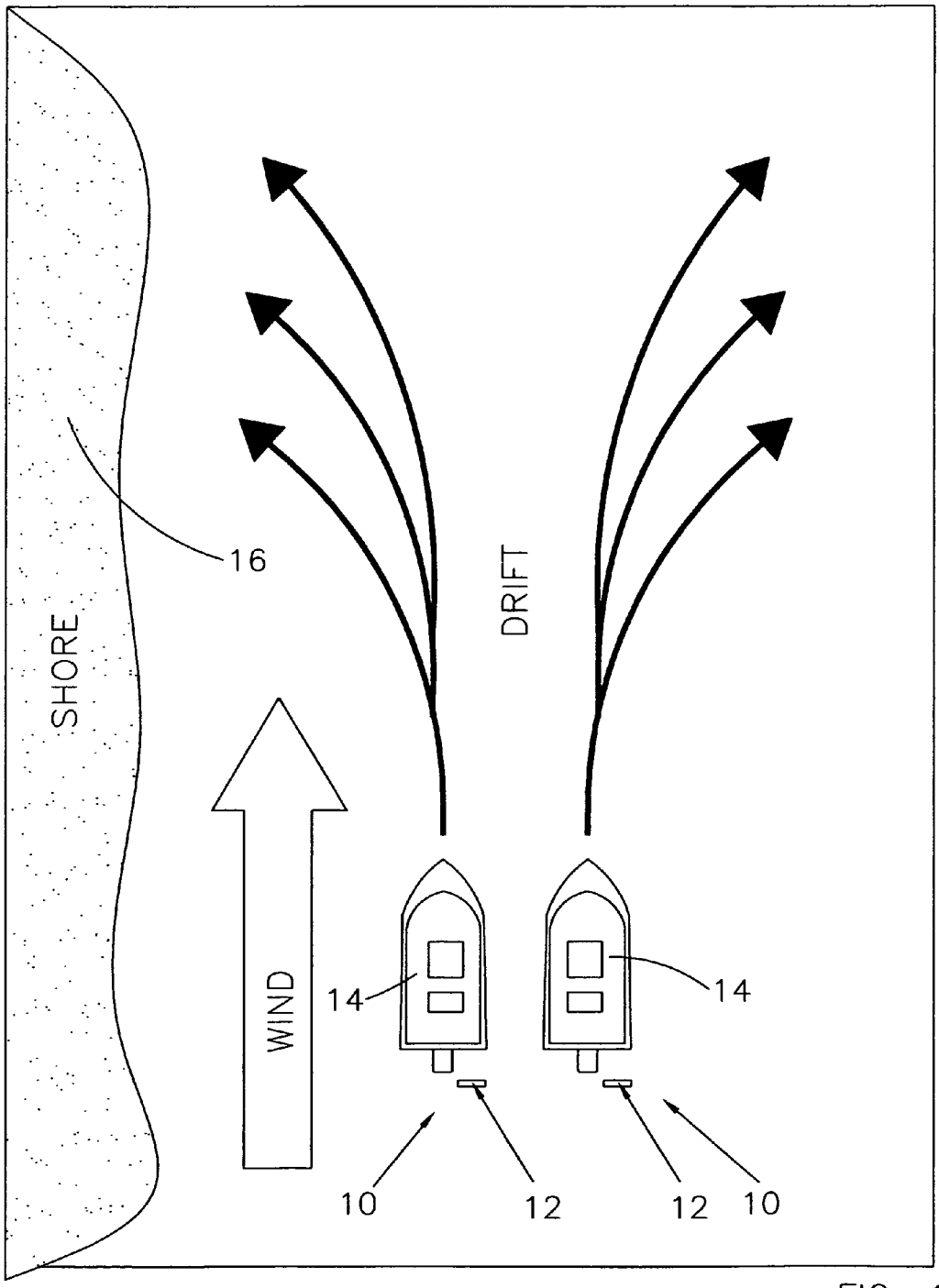
FIG. 1 is a schematic view illustrating the deployment of a single drift control device of the present invention coupled to the stern of a small boat.
Figure 2:
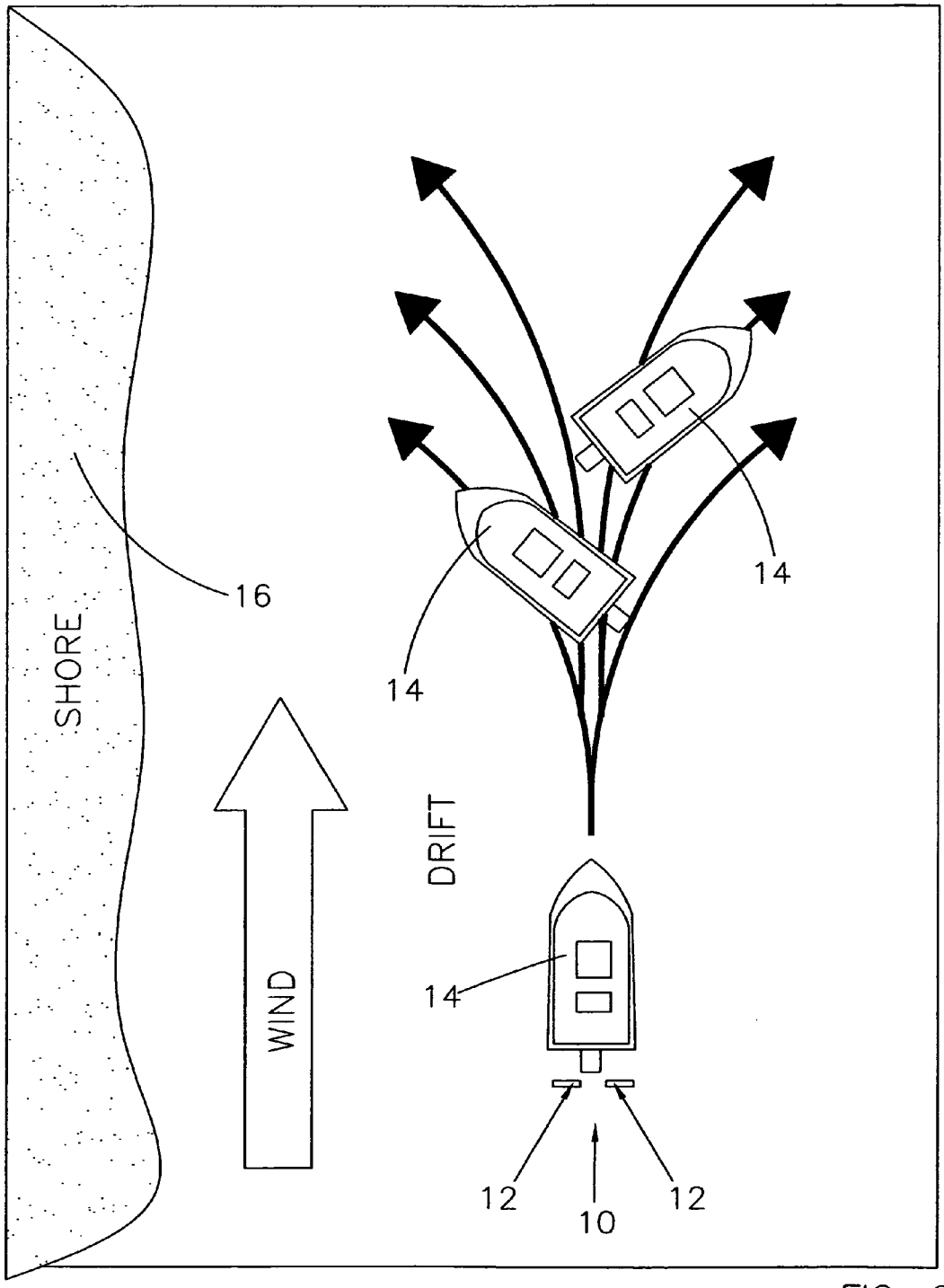
FIG. 2 is a schematic view illustrating the deployment of dual drift control device of the present invention coupled to the stern of a small boat.

As shown in FIGS. 1 and 2, the present invention relates to a drift control system generally indicated as 10 including at least one drift control device generally indicted as 12 coupled to the stern of a small boat 14 to control the bow angle relative to the shoreline 16 when drifting under the force of the wind and current. By changing the bow angle (center-line of the small boat 14 to shoreline) the direction of drift can be controlled.

Figure 3:
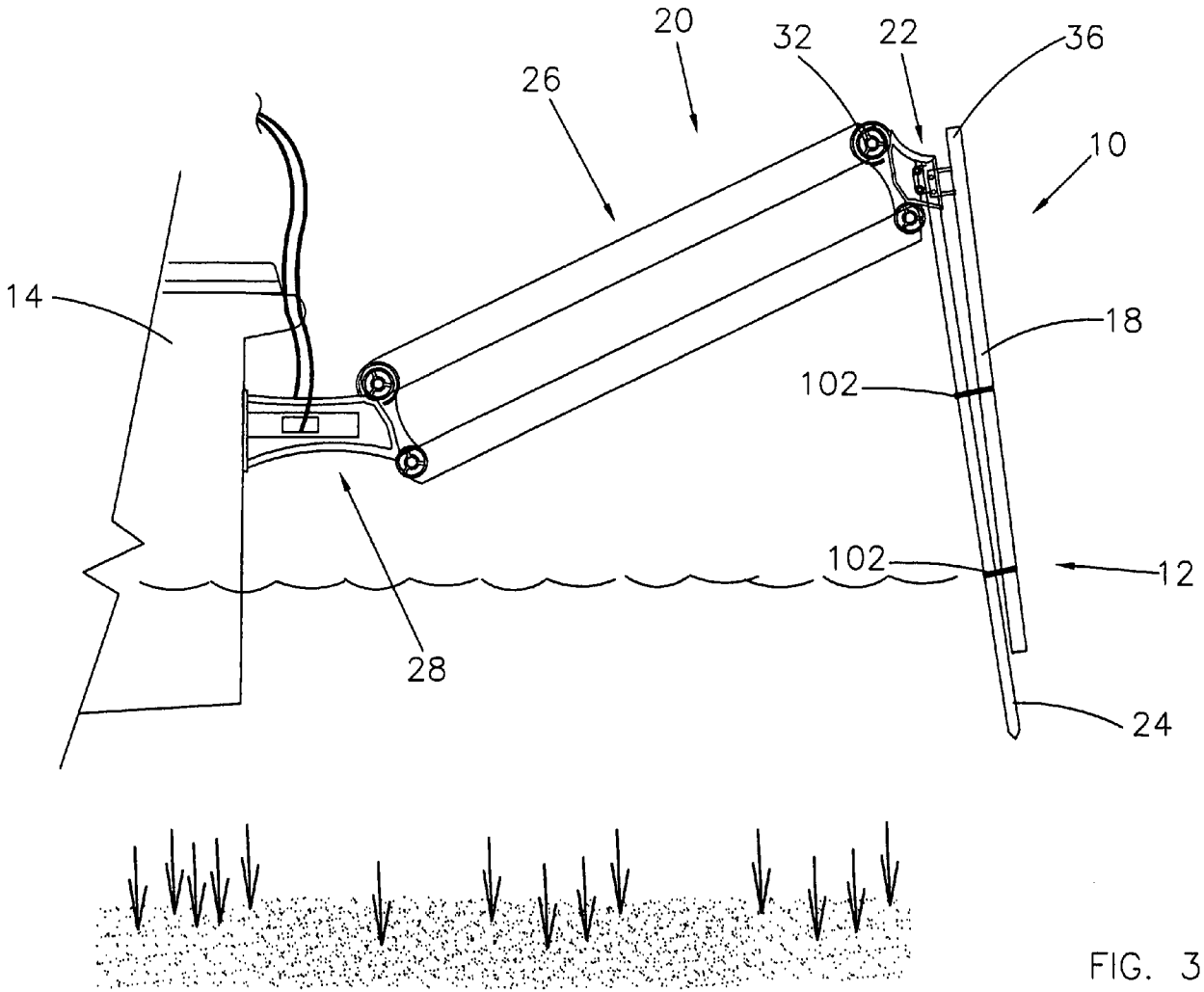
FIG. 3 is a side view of the drift control device of the present invention mounted on a pole anchor attached to the stern of a small boat.

As best shown in FIG. 3, the drift control device 12 comprises a rudder-like member or substantially pie-shaped member 18 coupled to a shallow water anchor generally indicated as 20 similar to the shallow water anchor disclosed and described in U.S. Pat. No. 6,041,730 by a mounting assembly generally indicated as 22. Specifically, the shallow water anchor 20 may comprise a flexible pole 24 coupled to the stern of the small boat 14 by a pole positioning device or actuator generally indicated as 26 affixed to the stern of the small boat 14 by an attachment means generally indicated as 28. The flexible pole 24 is not anchored in the bottom of the body of water.

Of course, the mounting assembly 22 may be coupled directly to the stern of the small boat 14 or other suitable coupling or connecting structure attached to the small boat 14.

Figure 4:
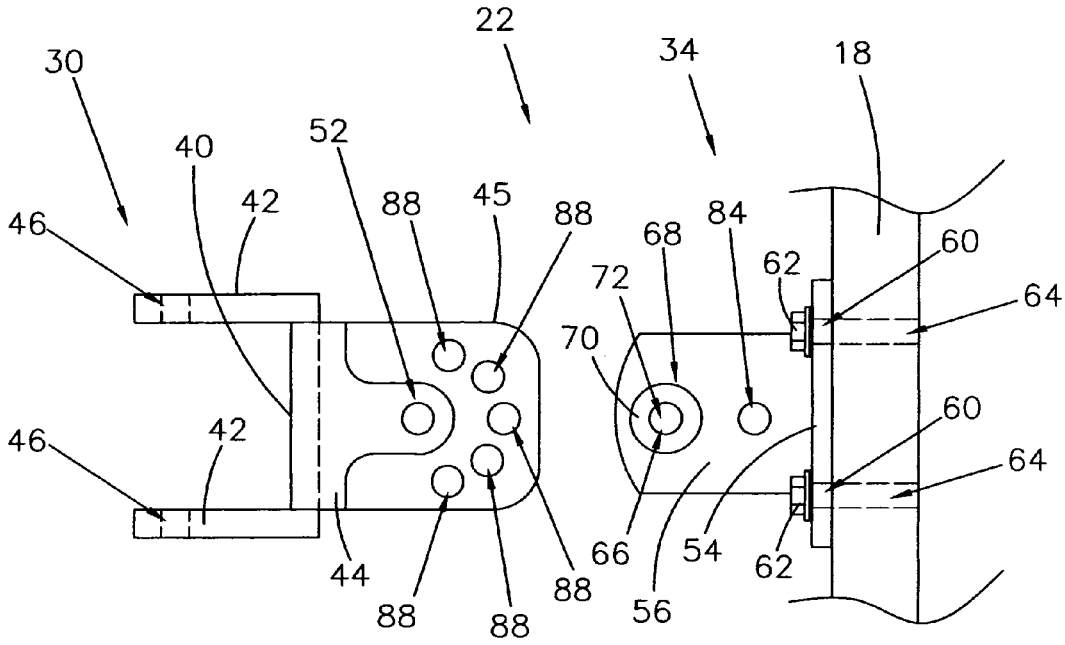
FIG. 4 is an exploded top view of the drift control device of the present invention.
Figure 5:
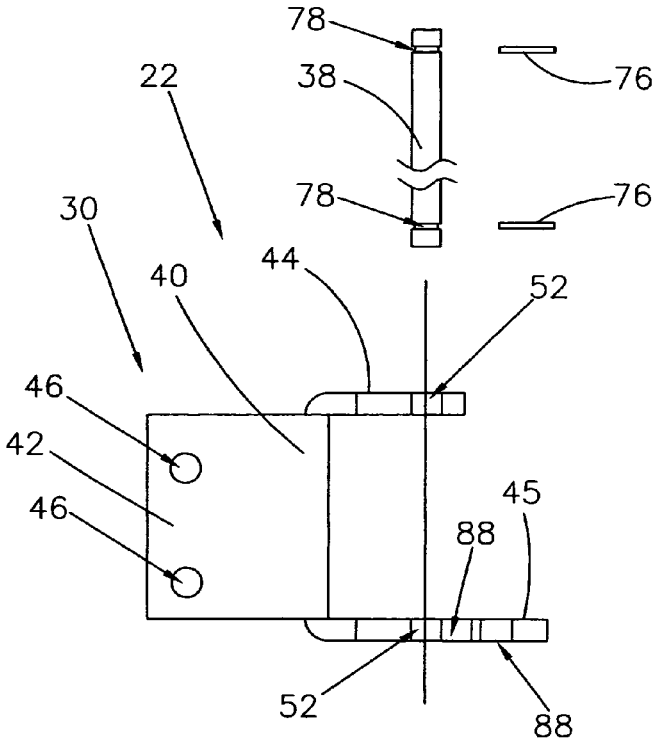
FIG. 5 is a side view of the first mounting bracket of the drift control device of the present invention.
Figure 6:
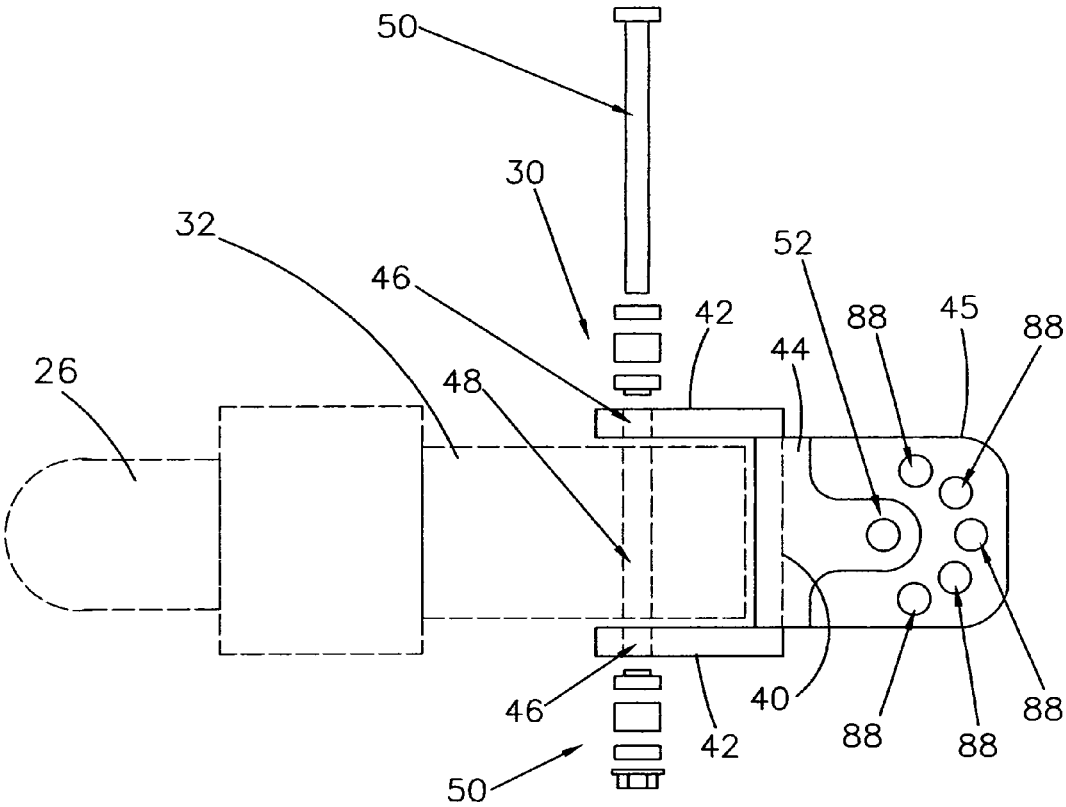
FIG. 6 is a top view of the first mounting bracket of the drift control device of the present invention.

As best shown in FIGS. 4 through 6, the mounting assembly 22 comprises a first mounting bracket generally indicated as 30 attached to the distal end portion 32 of the pole positioning device or actuator 26 and a second mounting bracket generally indicated as 34 attached to the upper portion 36 of the rudder-like or substantially pie-shaped member 18 and rotatably coupled to the first mounting bracket 30 by a coupling member generally indicated as 38.

As shown in FIGS. 4 through 6, the first mounting bracket 30 comprises a first base plate 40 having a pair of substantially parallel first mounting plates each indicated as 42 disposed in spaced relationship relative to each other to engage opposite sides of the distal end portion 32 of the pole positioning device or actuator 26 to attach the first mounting bracket 30 thereto and a first upper coupling plate and a first lower coupling plate indicated as 44 and 45 respectively disposed in substantially parallel spaced relationship relative to each other to receive a portion of the second mounting bracket 34 therebetween as described hereinafter.

As shown in FIGS. 4 through 6, each first mounting plate 42 includes at least two holes or apertures each indicated as 46 secured in alignment with corresponding holes or apertures 48 formed through the distal end portion 32 of the pole positioning device or actuator 26 by a corresponding fastening 50 such as a nut and bolt combination. The first upper coupling plate 44 and first lower coupling plate 45 include a corresponding hole or aperture 52 to receive the coupling member 38 therethrough.

Figure 7:
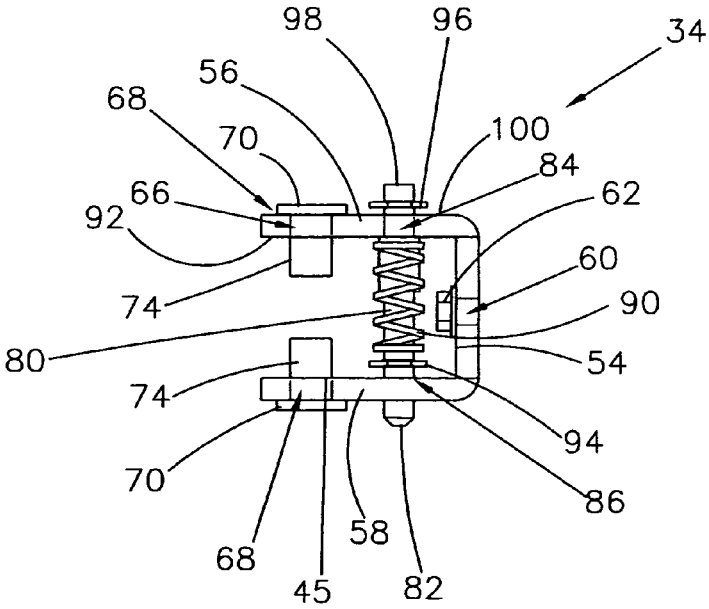
FIG. 7 is a side view of the second mounting bracket of the drift control device of the present invention.

As shown in FIGS. 4 and 7, the second mounting bracket 34 comprises a second base plate 54 having a second upper coupling plate and a second lower coupling plate indicated as 56 and 58 respectively in substantially parallel spaced relationship relative to each other disposed between the first upper coupling plate 44 and first lower coupling plate 45 of the first mounting bracket 30. The second base plate 54 of the second mounting bracket 34 includes a pair of holes or apertures each indicated as 60 to receive fasteners 62 such as a nut and bolt combination extending through holes or apertures 60 and corresponding holes or apertures 64 formed through the rudder-like or substantially pie-shaped member 18 to secure the second mounting bracket 34 to the upper portion 36 of the rudder-like or substantially pie-shape member 18.

As shown in FIGS. 4 and 7, the second upper coupling plate 56 and second lower coupling plate 58 each includes a hole or aperture 66 to receive a corresponding spacer alignment member or bearing member generally indicated as 68 comprising an enlarged spacer element 70 including a hole or aperture 72 formed therethrough disposed between the first lower coupling plate 44 and second upper coupling plate 56, and the second lower coupling plate 58 and first lower substantially parallel coupling plate 45 and an enlongated hollow coupler member alignment sleeve 74 to receive the coupler member 38 therethrough to vertically stabilize the coupler member 38.

As shown in FIG. 5, the coupler member 38 is restrained in vertical movement relative to the first mounting bracket 30 and the second mounting bracket 34 by a pair of snap rings or limits each indicated as 76 secured within a corresponding pair of grooves each indicated as 78.

The drift control device 12 further includes a locking assembly to selectively lock the second mounting bracket 34 relative to the first mounting bracket 30 in one of a plurality of positions to adjust the angular disposition of the rudder-like or substantially pie-shaped member 18 relative to the center-line of the small boat 14, i.e. bow angle.

As shown in FIGS. 4 through 7, the adjustable locking assembly comprises an elongated substantially cylindrical locking member 80 including a tapered reduced lower portion 82 movable between a first or locked position and a second or unlocked position extending through holes or apertures 84 and 86 formed through the second upper coupling plate 56 and second lower coupling plate 58 and into one of a plurality of recesses or holes each indicated as 88 formed in an arc on or in the upper surface of the second lower coupling plate 58 to lock or secure the second mounting bracket 34 relative to the first mounting bracket 30 in rotational position relative to each other and the bow of the small boat 14.

As shown in FIG. 7, the elongated substantially cylindrical locking member 80 is normally held in the first or locked position by a positioning member 90 such as bias or compression spring mounted on the elongated substantially cylindrical locking member 80 disposed in operative engagement between the lower surface 92 of the second upper coupling plate 56 of the second mounting bracket 34 and a snap ring or lower limit 94 affixed to the lower end portion of the elongated substantially cylindrical locking member 80. An upper snap spring or limit member 96 is affixed to the upper end portion 98 of the elongated substantially cylindrical locking member 80 to engage the upper surface 100 of the second upper coupling plate 56 of the second mounting bracket 34 to limit downward movement of the elongated substantially cylindrical locking member 80.

As shown in FIG. 3, one or more retainer elements such as straps or collars each indicated as 102 may secure the lower portion of the rudder-like member or substantially pie-shaped member 18 to the flexible pole 24.

To adjust the angle of the rudder-like member or substantially pie-shaped member 18 relative to the bow or center-line of the small boat 14 to control the drift angle, the elongated substantially cylindrical locking member 80 is lifted upward against the force or bias of the positioning member 90 removing the tapered reduced lower portion 82 from the recesses or holes 88 such that the second mounting bracket 34 and rudder-like member or substantially pie-shaped member 18 can be rotated relative to the first mounting bracket 30 on the coupling member 38. When the rudder-like member or substantially pie-shaped member 18 is properly positioned and the tapered reduced lower portion 82 of the elongated substantially cylindrical locking member 80 is aligned with the proper recess or hole 88 of the plurality of recesses or holes 88 the elongated substantially cylindrical locking member 80 is released allowing the elongated substantially cylindrical locking member 80 to return to the first or locked position under the face of the positioning member 90 causing the taped reduced lower portion 82 to seat in the proper recess or hole 88.

By raising or lowering the flexible pole 24, the surface area of the rudder-like member or substantially pie-shaped member 18 submerged charges either decreasing or increasing the fluid resistance of the water to the drift of the small boat.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described:

What is claimed is:

1. A drift control system including at least one drift control device for use with a boat to effect the direction and speed of drift of the boat against the forces of wind and current comprising a member adjustably coupled to the boat by a mounting assembly including a first mounting bracket coupled to the boat and a second mounting bracket rotatably coupled to the first mounting bracket by a coupling member and attached to said member, and an adjustable locking assembly to selectively secure said member in one of a plurality of positions relative to the boat to effect the direction and speed of drift of the boat against the forces of wind and current wherein said first mounting bracket comprises a first base plate having a first upper coupling plate and a first lower coupling plate formed thereon disposed in substantially parallel spaced relationship relative to each other to receive a portion of said second mounting bracket and said second mounting bracket comprises a second base plate having a second upper coupling plate and a second lower coupling plate in substantially parallel spaced relationship relative to each other disposed between said first upper coupling plate and said first lower coupling plate of the said mounting bracket.

2. The drift control system of claim 1 wherein said first upper coupling plate and first lower coupling plate each includes a corresponding hole to receive said coupling member therethrough and said second upper coupling plate and said second lower coupling plate each includes a hole to receive a corresponding bearing member comprising an enlarged spaced element including a hole formed therethrough disposed between said first lower coupling plate and said second upper coupling plate and said second lower coupling plate and said first lower substantially parallel coupling plate.

3. The drift control system of claim 2 wherein said bearing member further includes an elongated hollow coupler member alignment sleeve to receive said coupling member therethrough to vertically stabilize said coupling member.

4. The drift control system of claim 2 wherein said coupling member is restrained in vertical movement relative to said first mounting bracket and said second mounting bracket by a snap ring or limit secured within a corresponding groove formed on opposite end portion thereof.

5. The drift control system of claim 1 wherein said adjustable locking assembly selectively locks said second mounting bracket relative to said first mounting bracket in one of a plurality of positions to adjust the angular disposition of said member relative to the center-line of the boat.

6. The drift control system of claim 5 wherein said adjustable locking assembly comprises a locking member movable between a first or locked position and a second or unlocked position extending through holes formed through said second upper coupling plate and said second lower coupling plate and into one of a plurality of recesses or holes formed in an arc on or in the upper surface of said second lower coupling plate to lock or secure said second mounting bracket relative to said first mounting bracket in rotational position relative to each other and the bow of the boat.

7. The drift control system of claim 6 wherein said locking member includes a tapered reduced lower portion.

8. The drift control system of claim 6 wherein said locking member is normally held in said first or locked position by a positioning member mounted on said locking member disposed in operative engagement between the lower surface of said second upper coupling plate and a lower limit affixed to lower end portion of said locking member.

9. The drift control system of claim 8 wherein said positioning member comprises a bias or compression spring.

10. The drift control system of claim 8 wherein an upper snap spring or limit member is affixed to the upper end portion of said locking member to engage the upper surface of said second upper coupling plate to limit downward movement of said locking member.

11. The drift control system of claim 1 wherein said first mounting bracket further comprises a pair of substantially parallel first mounting plates disposed in spaced relationship relative to each other to engage opposite sides of the distal end portion of a pole positioning device or actuator to attach said first mounting bracket thereto.

12. The drift control system of claim 11 wherein said pair of substantially parallel first mounting plates are coupled to a shallow water anchor comprising a pole coupled to the stern of the small boat by a pole positioning device or actuator affixed to the stern of the boat by a pole positioning device or actuator affixed to the stern of the boat.

13. The drift control system of claim 12 further including at least retainer element to secure the mid portion of said member to said pole.

14. The drift control system of claim 13 wherein said retainer element comprises a strap or collar to secure said member to said pole.

15. A drift control system including at least one drift control device for use with a boat to effect the direction and speed of drift of the boat against the forces of wind and current comprising a rudder member adjustably coupled to the boat by a mounting assembly including a first mounting bracket coupled to the boat and a second mounting bracket rotatably coupled to the first mounting bracket by a coupling member and attached to said rudder member, and an adjustable locking assembly to selectively secure said rudder member in one of a plurality of angular positions about a substantially vertical axis relative to the center line of the boat to effect the direction and speed of drift of the boat against the forces of wind and current.

16. The drift control system of claim 15 wherein said first mounting bracket comprises a first base plate having a first upper coupling plate and a first lower coupling plate formed thereon disposed in substantially parallel spaced relationship relative to each other to receive a portion of said second mounting bracket and said second mounting bracket comprises a second base plate having a second upper coupling plate and a second lower coupling plate in substantially parallel spaced relationship relative to each other disposed between said first upper coupling plate and said first lower coupling plate of the said mounting bracket.

17. The drift control system of claim 16 wherein said first upper coupling plate and first lower coupling plate each includes a corresponding hole to receive said coupling member therethrough and said second upper coupling plate and said second lower coupling plate each includes a hole to receive a corresponding bearing member comprising an enlarged spaced element including a hole formed therethrough disposed between said first lower coupling plate and said second upper coupling plate and said second lower coupling plate and said first lower substantially parallel coupling plate.

18. The drift control system of claim 17 wherein said bearing member further includes an elongated hollow coupler member alignment sleeve to receive said coupling member therethrough to vertically stabilize said coupling member.

19. The drift control system of claim 17 wherein said coupling member is restrained in vertical movement relative to said first mounting bracket and said second mounting bracket by a snap ring or limit secured within a corresponding groove formed on opposite end portion thereof.

20. The drift control system of claim 16 wherein said adjustable locking assembly selectively locks said second mounting bracket relative to said first mounting bracket in one of a plurality of positions to adjust the angular disposition of said member relative to the center-line of the boat.

21. The drift control system of claim 20 wherein said adjustable locking assembly comprises a locking member movable between a first or locked position and a second or unlocked position extending through holes formed through said second upper coupling plate and said second lower coupling plate and into one of a plurality of recesses or holes formed in an arc on or in the upper surface of said second lower coupling plate to lock or secure said second mounting bracket relative to said first mounting bracket in rotational position relative to each other and the bow of the boat.

22. The drift control system of claim 21 wherein said locking member includes a tapered reduced lower portion.

23. The drift control system of claim 21 wherein said locking member is normally held in said first or locked position by a positioning member mounted on said locking member disposed in operative engagement between the lower surface of said second upper coupling plate and a lower limit affixed to lower end portion of said locking member.

24. The drift control system of claim 23 wherein said positioning member comprises a bias or compression spring.

25. The drift control system of claim 23 wherein an upper snap spring or limit member is affixed to the upper end portion of said locking member to engage the upper surface of said second upper coupling plate to limit downward movement of said locking member.

26. The drift control system of claim 16 wherein said first mounting bracket further comprises a pair of substantially parallel first mounting plates disposed in spaced relationship relative to each other to engage opposite sides of the distal end portion of a pole positioning device or actuator to attach said first mounting bracket thereto.

27. The drift control system of claim 26 wherein said pair of substantially parallel first mounting plates are coupled to a shallow water anchor comprising a pole coupled to the stern of the boat by a pole positioning device or actuator affixed to the stern of the boat.

28. The drift control system of claim 27 further including at least retainer element to secure the mid portion of said member to said pole.

29. The drift control system of claim 28 wherein said retainer element comprises a strap or collar to secure said member to said pole.

30. A drift control system including at least one drift control device for use with a boat to effect the direction and speed of drift of the boat against the forces of wind and current comprising a rudder member adjustably coupled to the boat by a mounting assembly including a first mounting bracket coupled to the boat and a second mounting bracket rotatably coupled to the first mounting bracket by a coupling member and attached to said rudder member, and an adjustable locking assembly to selectively secure said rudder member in one of a plurality of angular positions about a substantially vertical axis relative to the boat to effect the direction and speed of drift of the boat against the forces of wind and current wherein said adjustable locking assembly selectively locks said second mounting bracket relative to said first mounting bracket in one of a plurality of positions to adjust the angular disposition of said member relative to the center-line of the boat.

31. The drift control system of claim 30 wherein said first mounting bracket comprises a first base plate having a first upper coupling plate and a first lower coupling plate formed thereon disposed in substantially parallel spaced relationship relative to each other to receive a portion of said second mounting bracket and said second mounting bracket comprises a second base plate having a second upper coupling plate and a second lower coupling plate in substantially parallel spaced relationship relative to each other disposed between said first upper coupling plate and said first lower coupling plate of the said mounting bracket.

32. The drift control system of claim 31 wherein said first upper coupling plate and first lower coupling plate each includes a corresponding hole to receive said coupling member therethrough and said second upper coupling plate and said second lower coupling plate each includes a hole to receive a corresponding bearing member comprising an enlarged spaced element including a hole formed therethrough disposed between said first lower coupling plate and said second upper coupling plate and said second lower coupling plate and said first lower substantially parallel coupling plate.

33. The drift control system of claim 32 wherein said bearing member further includes an elongated hollow coupler member alignment sleeve to receive said coupling member therethrough to vertically stabilize said coupling member.

34. The drift control system of claim 32 wherein said coupling member is restrained in vertical movement relative to said first mounting bracket and said second mounting bracket by a snap ring or limit secured within a corresponding groove formed on opposite end portion thereof.

35. The drift control system of claim 30 wherein said adjustable locking assembly comprises a locking member movable between a first or locked position and a second or unlocked position extending through holes formed through said second upper coupling plate and said second lower coupling plate and into one of a plurality of recesses or holes formed in an arc on or in the upper surface of said second lower coupling plate to lock or secure said second mounting bracket relative to said first mounting bracket in rotational position relative to each other and the bow of the boat.

36. The drift control system of claim 35 wherein said locking member includes a tapered reduced lower portion.

37. The drift control system of claim 35 wherein said locking member is normally held in said first or locked position by a positioning member mounted on said locking member disposed in operative engagement between the lower surface of said second upper coupling plate and a lower limit affixed to lower end portion of said locking member.

38. The drift control system of claim 37 wherein said positioning member comprises a bias or compression spring.

39. The drift control system of claim 37 wherein an upper snap spring or limit member is affixed to the upper end portion of said locking member to engage the upper surface of said second upper coupling plate to limit downward movement of said locking member.

40. The drift control system of claim 31 wherein said first mounting bracket further comprises a pair of substantially parallel first mounting plates disposed in spaced relationship relative to each other to engage opposite sides of the distal end portion of a pole positioning device or actuator to attach said first mounting bracket thereto.

41. The drift control system of claim 40 wherein said pair of substantially parallel first mounting plates are coupled to a shallow water anchor comprising a pole coupled to the stern of the boat by a pole positioning device or actuator affixed to the stern of the boat.

42. The drift control system of claim 41 further including at least retainer element to secure the mid portion of said member to said pole.

43. The drift control system of claim 42 wherein said retainer element comprises a strap or collar to secure said member to said pole.

* * * * *